US005702876A

United States Patent [19]

Taylor et al.

[11] Patent Number: 5,702,876

[45] Date of Patent: Dec. 30, 1997

[54] PHOTOGRAPHIC FILM BASE AND COLOR PHOTOGRAPHIC MATERIAL COMPRISING A BINDERLESS MAGNETIC LAYER

[75] Inventors: Phillip A. Taylor, Lake Elmo; Jeffrey M. Florczak, Maplewood, both of Minn.; Mark A. Peterson, River Falls; Paul R. Iverson, St. Croix Falls, both of Wis.; Joseph Skorjanec, White Bear Lake; Robert D. Lorentz, North Oaks, both of Minn.

[73] Assignee: Minnesota Mining and Manufacturing Company, St. Paul, Minn.

[21] Appl. No.: 640,419

[22] Filed: Apr. 30, 1996

[51] Int. Cl.[6] ..... G03C 1/76

[52] U.S. Cl. ..... 430/496; 430/140; 430/523; 430/495.1; 430/501; 430/524

[58] Field of Search ..... 430/140, 523, 430/495.1, 496, 501, 524

[56] References Cited

U.S. PATENT DOCUMENTS

| | | | |
|---|---|---|---|
| 3,342,632 | 9/1967 | Bate et al. | 117/217 |
| 3,342,633 | 9/1967 | Bate et al. | 117/217 |
| 4,713,262 | 12/1987 | Yasunaga et al. | 427/130 |
| 4,743,348 | 5/1988 | Ando et al. | 204/192.2 |
| 5,254,446 | 10/1993 | Ikenoue et al. | 430/503 |
| 5,254,449 | 10/1993 | James et al. | 430/533 |
| 5,336,589 | 8/1994 | Mukunoki et al. | 430/501 |

*Primary Examiner*—Mark F. Huff

*Attorney, Agent, or Firm*—Walter N. Kirn; Gregory A. Evearitt; Arlene K. Musser

[57] ABSTRACT

The present invention relates to a photographic film base comprising a transparent support base and a binderless layer of magnetic material coated thereon.

According to another aspect, the present invention relates to a color photographic material comprising a photographic film base and at least one light-sensitive layer coated thereon, wherein said photographic film base comprises a transparent support base and a binderless layer of magnetic material coated thereon.

17 Claims, No Drawings

PHOTOGRAPHIC FILM BASE AND COLOR PHOTOGRAPHIC MATERIAL COMPRISING A BINDERLESS MAGNETIC LAYER

FIELD OF THE INVENTION

The present invention relates to a photographic film base having a layer of binderless magnetic material coated thereon. More particularly, it relates to a photographic film base having a binderless magnetic layer coated thereon providing good magnetic and optical properties. Most particularly, it relates to a photographic film element comprising a binderless magnetic layer coated on the support base thereof.

BACKGROUND OF THE ART

Photographic element have mainly comprised a transparent support base of a suitable polymeric compound, such as polyester, having coated thereon one or more light sensitive layer(s) and other hydrophilic colloid layers such as interlayers, filter layers, protective layers, antistatic layers.

In recent years, with the development of so called minilabs, the amount of different types of information that would be desirable to provide on a photographic element has become higher and higher.

For example, it would be desirable to put on the photographic film information relating to its sensitivity, the exposure conditions of the film (such a exposure time and f-stop number), date and time of exposure, name of photographer, various messages relating to development and printing (such as number of reprints, portion to be zoomed, and the like).

The information that could be stored on a conventional light-sensitive photographic element were limited by its composition in optical format. Date and time of exposure could be impressed on the photographic film, but other information could not and in any case, once registered on the film, it cannot be modified anymore.

Optical information can be stored by the manufacturer of the photographic material, but subsequent information which could also be useful for minilabs, such as exposure conditions, cannot be subsequently recorded on the photographic film.

A number of patents, such as, for example, U.S. Pat. Nos. 4,990,276, 5,147,768, 5,215,874, 5,217,804, 5,227,283, 5,229,259, 5,238,794, 5,250,404, 5,252,441, 5,254,446, 5,254,449 and 5,336,589 describe a magnetic layer coated on a transparent support to be used for photographic materials. The magnetic layer described in the above patents comprises a magnetic material dispersed in a binder. The presence of a magnetic layer on the photographic film, together with a proper input/output system, makes possible and/or easier the incorporation of the above types of information onto the photographic element.

The magnetic layer described in the above mentioned patents may be prepared dispersing various magnetic particles (usually iron oxide or alloys thereof particles) in a homogeneous composition including a transparent binder and a solvent for the binder. Transparent binders include cellulose organic esters, polyurethanes, polyesters and polycarbonates. Binder solvents include methylene chloride, methyl alcohol, methyl ethyl ketone, ethyl/butyl acetate, cyclohexanone, and dimethylformamide. Furthermore, the dispersing medium can comprise other transparent additives, such as, tricresyl phosphate and dibutyl phthalate, and lubricants such as carbonic acid mixed esters.

The magnetic layer should be thinner than 1.5 μm, transparent to visible radiation, uniform in density, and have sufficient magnetic properties, and the dispersed coating solution must have a proper concentration of magnetic material particles and binder, be well stabilized and lastly, the surface of the magnetic particles must be suitably modified to avoid agglomeration.

To prepare a stable coating dispersion, the conventional way would be to have a large amount of magnetic material in a small amount of binder, but this composition would provide a magnetic layer which is not sufficiently thin to allow for easy coating and application of the layer. To reduce the thickness of the magnetic layer, the concentration of the magnetic material should be lowered, but in this case the magnetic particles tend to agglomerate, by forming clumps of non-uniform size that can promote light scattering and increase optical density. Moreover, the presence of the binder reduces the amount of magnetic material in the layer, and to obtain such good magnetic properties, the optical properties of the film are negatively affected.

Accordingly, there is still the need of a photographic film base which solves the above mentioned disadvantages and has good optical and magnetic properties.

SUMMARY OF THE INVENTION

The present invention relates to a photographic film base comprising a transparent support base and a binderless layer of magnetic material coated thereon.

According to another aspect, the present invention relates to a color photographic material comprising a photographic film base and at least one light-sensitive layer coated thereon, wherein said photographic film base comprises a transparent support base and a binderless layer of magnetic material coated thereon.

DETAILED DESCRIPTION OF THE INVENTION

The present invention relates to a photographic film base comprising a transparent support base and a binderless layer of magnetic material coated thereon.

Examples of materials suitable for the preparation of the transparent support base include cellulose nitrates, cellulose acetates, polystyrene, polyesters such as polyethylene terephthalate, polyethylene naphthalate, polyethylene, polypropylene and other well known transparent supports.

Examples of magnetic materials include metals such as Fe, Co, Ni, and the like, metal oxides such as CoO, CoNiO, γ-Fe2O3, Fe3O4, and the like, ferro magnetic alloys such as Fe—Co, Co—Ni, Co—Pt, Co—Au, Fe—Rh, Fe—Ni, Co—Cu, CoY, Co—La, Fe—Cr, Co—Cr, Fe—Co—Cr, Ni—Co—Cr, Fe—Co—Cr, Co—Cr—Pt, Co—Cr—Ta, Co—Fe—Ni, Fe—Co—No—Cr, and the like. Co, Co oxide and alloys comprising more than 50% by weight of Co are preferred.

The magnetic material is applied to the transparent support base by using a physical or chemical deposition process, such as, for example, sputtering, vacuum deposition, electron beam or thermal vapor deposition.

Sputtering techniques are described in, for example, U.S. Pat. Nos. 3,856,579 and 3,625,849, vacuum deposition is described in, for example, U.S. Pat. Nos. 4,354,908, 4,343,834, 4,245,008, 4,074,016, electron beam deposition is described in, for example, U.S. Pat. No. 4,511,594, thermal vapor evaporation is described in, for example, U.S. Pat. Nos. 4,501,225, 4,451,501, and 4,713,262.

In particular, a method for manufacturing magnetic recording media by vacuum deposition is very advantageous because it does not require a treatment for waste liquids which is needed in the case of plating, it is a simple process and can be operated at a high deposition speed. A particularly effective method of vacuum deposition includes an oblique vapor deposition as described, for example in U.S. Pat. Nos. 3,342,632 and 3,342,633.

In oblique vapor deposition, the transparent support base in form of a film is conveyed along a cooling can and a vapor stream of a ferromagnetic metal material evaporated from an evaporation source is allowed to collide with the moving support base obliquely, i.e., at a predetermined angle of incidence. To obtain a magnetic layer having improved coercive force, the angle of incidence of the vapor stream on the transparent support base should be at least 45°. The deposition process is conducted in an evaporation chamber which is connected to a vacuum device to provide an internal vacuum usually within the range of from $10^{-2}$ to $10^{-8}$ Torr. To improve the magnetic characteristics of the resulting coated magnetic layer a gas is usually added into the evaporation chamber. Examples of suitable gases are oxygen, nitrogen, carbon dioxide, rare gases such as argon, neon, krypton, xenon, radon and helium, nitrogen oxides such as $N_2O$, $N_2O_3$, $NO_2$ $N_2O_4$ and $N_2O_5$, and mixtures thereof.

The vapor stream of ferromagnetic material is provided by heating the ferromagnetic material by means of different heating methods, e.g., an electrical resistance heating method, a laser beam heating method, a radio frequency induction heating method, or an electron beam heating method. Electron beam heating method is preferred and various electron bean guns can be used such as a Pierce type electron gun, a deflecting electron gun, and a hollow cathode electron gun.

To maintain the good optical properties of the support base, such as transparency to visible light and color neutrality, the binderless magnetic layer should be as thin as possible, provided that sufficient magnetic properties to record information are maintained. After extensive investigation, the inventors have found that the proper range of thickness is from 0.1 nm to 100 nm, preferably from 1 nm to 50 nm. The most preferred thickness ranges from 5 to 30 nm. The photographic film base of the present invention has a uniform density in the visible portion of the electromagnetic spectrum (i.e., 400 to 800 nm). In particular the red, green and blue density values are substantially equal to or lower than 0.50, preferably lower than 0.30, most preferably lower than 0.20. Haze percentage values of the photographic film base of the present invention are lower than 3%, more preferably lower than 2%, and most preferably lower than 1%.

Also, coercive force (or coercivity) of the magnetic layer should be between 200 and 950 Oe. If coercive force is lower than 200 Oe the magnetic layer could be easily demagnetized and the information recorded therein lost. On the other hand, if coercive force is higher than 950 Oe, the magnetic layer would be difficult to record with inexpensive magnetic heads.

While the coercivity relates to demagnetizability, the signal output from the transducer in a recording system is related to the remanent magnetization of the media. One of the limiting factors in a magnetic recording system is the signal to noise ratio. In constructing a magnetic medium with useful optical properties for association with photographic materials, the magnetic material must be greatly reduced in its concentration and amount as compared to conventional magnetic media. This lower level of magnetic material lowers the remanent magnetization, which in turn lowers the signal output and the signal to noise ratio of the system. In the present invention, a medium is produced with both usable optical properties and readable magnetic properties. For current state of the art magnetic head technology, the media of the present invention should have a remanent magnetization above about 1 emu/square meter.

As the photographic elements are subjected to various strong processing solutions which can deteriorate or destroy the magnetic layer. It is also desirable in the practice of the present invention to provide a protective coating over the magnetic layer of the photographic element. This is particularly true with binderless magnetic layers. The protective layer should be relatively thin (based on magnetic spacing loss considerations) and must possess suitable optical properties, preferably being transparent and colorless. The protective coating may be comprised of organic or inorganic compositions and materials such as diamond-like carbon layers deposited by physical deposition techniques, inorganic oxides, polymers (such as epoxies, acrylics, siloxanes, etc.) deposited by solvent or solventless techniques. It is preferred that the coatings also provide enhanced abrasion resistance (as provided by epoxy-silanes, acryloxysilanes, highly crosslinked acrylates (e.g., hydantoin hexaacrylate), and the like. The process of applying the coatings may be selected from amongst conventional coating technologies, and those capable of providing particularly thin layers (evaporation, plasma deposition, etc.) are preferred. The protective layers may be thinner than 10 nanometers (e.g., 2–10 nm) and still provide excellent protection. The optical properties of the coating may be tailored to improve the photographic appearance of the medium.

According to another aspect, the present invention relates to a color photographic material comprising a photographic film base and at least one light-sensitive layer coated thereon, wherein said photographic film base comprises a transparent support base and a binderless layer of magnetic material coated thereon.

The color photographic element of the present invention can be a conventional photographic element containing a silver halide as a light-sensitive substance. Silver halide color photographic elements usually comprise, coated on a support, at least one red sensitized silver halide emulsion layer, at least one green sensitized silver halide emulsion layer, and at least one blue sensitized silver halide emulsion layer. The color photographic material of the present invention preferably comprises the binderless layer of magnetic material coated on the side of the support base opposite to that the color sensitive silver halide emulsion layers are coated on. Composition, preparation process and characteristics of the photographic film base useful in the manufacture of the color photographic color material of the present invention are identical to what described above.

The silver halides used in the color photographic elements of this invention may be a fine dispersion (emulsion) of silver chloride, silver bromide, silver chloro-bromide, silver iodo-bromide and silver chloro-iodo-bromide grains in a hydrophilic binder. Preferred silver halides are silver iodo-bromide or silver iodo-bromo-chloride, containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 μm, more preferably from 0.4 to 1.5 μm. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in the color photographic material of the present invention are those which employ one or more light-sensitive tabular grain emulsions. The tabular silver halide grains have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains range from about 0.3 μm to about 5 μm, preferably 0.5 μm to 3 μm, more preferably 0.8 μm to 1.5 μm. The tabular silver halide grains have a thickness of less than 0.4 μm, preferably less than 0.3 μm and more preferably less than 0.2 μm.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having an average diameter:thickness ratio of at least 2:1 and a thickness lower than 0.4 μm, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing silver halide emulsions, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

Silver halide grain emulsions can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

Silver halide emulsions can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes,* Academic Press, New York, 1971, Chapter V, James, *The Theory of the Photographic Process,* 4th Ed., Macmillan, 1977, Chapter 8, F. M. Hamer, *Cyanine Dyes and Related Compounds,* John Wiley and Sons, 1964, and in Research Disclosure 308119, Section III, 1989.

Silver halide emulsions can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

Silver halide emulsions can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer can be comprised of a single emulsion layer or of multiple emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in any conventional order, but in a preferred layer arrangement the red-sensitive layers are coated nearest the support and are overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers, at least one non-diffusible magenta image-forming color coupler, generally a 5-pyrazolone or a pirazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924;

in British patent 1,201,110, and in Research Disclosure 308119, Section VII, 1989.

The most useful magenta-forming couplers are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers are conventional open-chain ketomethylene type couplers. Particular examples of such couplers are benzoylacetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650175, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in US Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator or bleaching accelerator, either directly or after removal of one or further groups from the group originally released. Examples of such 2-equivalent couplers include the known DIR couplers as well as DAR, FAR and BAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, in EP Pat. Appl. Nos. 89,843, 117,511, 118,087, 193,389, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75, in British patents 1,423,588 and 1,542,705 and 301,477 and in Research Disclosure 308119, Section VII, 1989.

To introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylendiamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-meth-oxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g. EDTA.Fe.$NH_4$, wherein EDTA is the ethylenediaminotetracetic acid, or PDTA.Fe.$NH_4$, wherein PDTA is the propylenediaminotetracetic acid. White processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following example, but is should be understood that the example does not limit the present invention.

EXAMPLE

A thin layer of CoNiO was coated onto a 10μm polyethyleneterephthalate photographic substrate by vacuum deposition. Seven samples (1 to 7) were prepared. Samples 1 to 4 were prepared in absence of any gas, and samples 5 to 7 were prepared in presence of a N2/O2 mixture having a molar ratio shown in the following Table 1. Each sample was coated with a different thickness that was monitored by measuring their optical transmission at 800 nm as shown in the following Table 1. The thickest sample (4) (having the lowest optical transmission) had a thickness of about 60 nm (0.06 μm).

TABLE 1

| Sample Number | N2/O2 Molar Ratio | Optical Transmission at 800 nm (%) |
|---|---|---|
| 1 | 0/0 | 76 |
| 2 | 0/0 | 68 |
| 3 | 0/0 | 40 |
| 4 | 0/0 | 17 |
| 5 | 50/100 | 37 |
| 6 | 50/100 | 76 |
| 7 | 50/100 | 56 |

Each sample was tested by evaluating is optical and magnetic properites. Haze was measured by using a BYK-Gardner XL-211 hazemeter. Calibration of the hazemeter was confirmed to be satisfactory using 1% and 5% haze standard tiles. L*a*b* values were measured with a Diano Matchscan II spectorphotomerter configured using monochromatic illumination and D65 2 degree observer. Density values were measured using a X-rite 310 densitometer. The reading were taken in transmission mode using the Status M R-G-B response function.

The results are summarized in the following Tables 2 (Optical Properties) and 3 (Magnetic Properties).

TABLE 2

| Sample Number | % Haze | L* | a* | b* | Red Density | Green Density | Blue Density |
|---|---|---|---|---|---|---|---|
| 1 | 0.743 | 94.01 | −0.01 | 1.72 | 0.04 | 0.05 | 0.05 |
| 2 | 0.628 | 89.29 | 0.15 | 1.38 | 0.10 | 0.10 | 0.10 |
| 3 | 0.686 | 76.30 | 0.16 | 0.46 | 0.28 | 0.28 | 0.28 |
| 4 | | 55.00 | 0.22 | −0.28 | 0.58 | 0.58 | 0.57 |
| 5 | 0.818 | 66.35 | 0.79 | 4.00 | 0.39 | 0.42 | 0.45 |
| 6 | 0.718 | 92.65 | 0.13 | 2.89 | 0.05 | 0.06 | 0.07 |
| 7 | 0.683 | 86.73 | 0.31 | 4.13 | 0.11 | 0.13 | 0.15 |
| Base | 0.845 | 95.12 | −0.01 | 0.66 | 0.03 | 0.03 | 0.03 |

TABLE 3

| Sample Number | Coercive Force (Oe) | Remanent Magnetization Ir (emu/sq. m.) |
|---|---|---|
| 1 | 378 | 0.54 |
| 2 | 548 | 0.190 |
| 3 | 238 | 2.810 |
| 4 | 380 | 13.960 |
| 5 | 465 | 2.430 |
| 6 | 129 | 0.082 |
| 7 | 53 | 0.146 |

Sample 4 has good magnetic properties, haze and Lab values, but its optical densities values are too high. Samples 6 and 7 have very good optical properties but their magnetic properties are not sufficient. Samples 1, 2, 3, and 5 show a good balance between optical and magnetic properties. The preferred sample is sample number 2, which shows very good optical and magnetic properties.

Examples 3 and 5 are the most preferred examples, having Hc and Ir values in the preferred ranges (200<Hc>950 ans 1<lr>10 emu/sq.m.). These ranges are merely preferences and are not limits on the practice of the present invention.

We claim:

1. A color photographic material comprising a photographic film base and at least one light-sensitive layer coated thereon, said photographic film base comprises a transparent support base and a binderless layer of magnetic material coated thereon, wherein said support base having said binderless layer coated thereon has an optical transmission greater than or equal to 37% at 800 nm.

2. The color photographic material according to claim 1, wherein said magnetic material is selected from the group consisting of ferromagnetic metals, metal oxides and alloys.

3. The color photographic material according to claim 1, wherein said magnetic material is selected from the group consisting of Co, Co oxides and alloys comprising more than 50 atomic % Co.

4. The color photographic material according to claim 1, wherein said transparent support base is selected from the group consisting of cellulose nitrate bases, cellulose acetate bases, polystyrene bases, polyester bases, polyimide bases, polyethylene bases, and polypropylene bases.

5. The color photographic material according to claim 4, wherein said polyester bases are polyethylene terephthalate base and polyethylene naphthalenate base.

6. The color photographic material according to claim 1, wherein said magnetic material is applied to the photographic substrate by using a physical or chemical deposition process.

7. The color photographic material according to claim 6, wherein said deposition process is selected from the group of vacuum deposition processes consisting of sputtering process, electron beam evaporation process and thermal vapor deposition process, and induction heating deposition process.

8. The color photographic material according to claim 1, wherein said binderless layer of magnetic material has a thickness of from 0.1 nm to 100 nm.

9. The color photographic material according to claim 1, wherein said binderless layer of magnetic material has a thickness of from 5 to 30 nm.

10. The color photographic material according to claim 1, wherein said binderless layer of magnetic material has a coercive force of from 200 and 2000 Oe.

11. The color photographic material according to claim 1, wherein said photographic film base has red, green and blue density values substantially equal to or lower than 0.50.

12. The color photographic material according to claim 1, wherein said photographic film base has red, green and blue density values equal to or lower than 0.30.

13. The color photographic material according to claim 1, wherein said photographic film base has a haze percentage value lower than 3%.

14. The color photographic material according to claim 1, wherein said photographic film base has a haze percentage value lower than 1%.

15. The color photographic material according to claim 1, wherein said binderless layer of magnetic material is coated on the side opposite the side said at least one light-sensitive layer is coated on.

16. The color photographic element of claim 1 wherein said magnetic material has a protective layer over it.

17. A color photographic material comprising a photographic film base and at least one light-sensitive layer coated thereon, wherein said photographic film base comprises a transparent support base and a binderless layer of magnetic material coated thereon, said magnetic material is selected from the group consisting of Co, Co oxides and alloys comprising more than 50 atomic % Co, said photographic film base has red, green and blue density values equal to or lower than 0.30, said photographic film base has a haze percentage value lower than 1%, and said binderless layer of magnetic material is coated on the side opposite the side said at least one light-sensitive layer is coated on.

* * * * *